US009783278B1

(12) United States Patent
Dannenberg et al.

(10) Patent No.: US 9,783,278 B1
(45) Date of Patent: Oct. 10, 2017

(54) TILLER HAVING REMOVABLE TOP COVER

(71) Applicant: Brunswick Corporation, Lake Forest, IL (US)

(72) Inventors: Todd D. Dannenberg, Fond du Lac, WI (US); Travis J. Vaninetti, Neenah, WI (US); Jeffrey A. Zarembka, Plymouth, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/236,534

(22) Filed: Aug. 15, 2016

(51) Int. Cl.
*B63H 20/12* (2006.01)
*B63H 21/21* (2006.01)

(52) U.S. Cl.
CPC ..... *B63H 20/12* (2013.01); *B63H 21/213* (2013.01)

(58) Field of Classification Search
CPC ..... B63H 20/08; B63H 20/12; B63H 25/06; B63H 25/12; B63H 21/21; B63H 21/22; B63H 21/30; B63H 21/265; B63H 21/213; F02B 61/00; F02B 61/04
USPC ..... 440/52, 53
See application file for complete search history.

(56) References Cited

U.S. PATENT DOCUMENTS 4,496,326 A 1/1985 Boda
4,878,468 A 11/1989 Boda et al.
5,145,427 A * 9/1992 Kawai ..... F02B 61/045 440/52
5,340,342 A 8/1994 Boda et al.
5,632,657 A 5/1997 Henderson
6,264,516 B1 7/2001 McEathron et al.
6,406,342 B1 6/2002 Walczak et al.
7,090,551 B1 8/2006 Lokken et al.
D611,501 S 3/2010 Vignau et al.
D611,502 S 3/2010 Vignau et al.
7,677,938 B2 3/2010 Wiatrowski et al.
7,704,110 B2 4/2010 Wiatrowski et al.
7,895,959 B1 3/2011 Angel et al.
8,257,122 B1 9/2012 Holley
2004/0137806 A1 * 7/2004 Ohtsuki ..... F02B 61/045 440/1

* cited by examiner

*Primary Examiner* — Lars A Olson
(74) *Attorney, Agent, or Firm* — Andrus Intellectual Property Law, LLP

(57) ABSTRACT

A tiller is for an outboard motor. The tiller comprises a supporting chassis having a first end and an opposite, second end. A rotatable throttle grip is supported on the first end and a pivot joint is located at the second end. The pivot joint is configured to facilitate pivoting of the tiller at least into and between a horizontal position wherein the supporting chassis extends horizontally and a vertical position wherein the supporting chassis extends vertically. A top cover is located on the supporting chassis. The top cover and the supporting chassis together define an interior of the tiller. The top cover is located vertically on top of the supporting chassis when the tiller is in the horizontal position.

10 Claims, 6 Drawing Sheets

TILLER HAVING REMOVABLE TOP COVER

FIELD

The present disclosure relates to outboard marine engines, and particularly to tillers for outboard marine engines.

BACKGROUND

The following U.S. Patents are incorporated herein by reference, in entirety:

U.S. Pat. No. 8,257,122 discloses a multi-function throttle shaft that combines motor speed-control and motor direction-control in one tiller handle. Co-functionally, the throttle shaft is rotated clockwise/counterclockwise to control motor speed while intuitively allowing the user to push the throttle in for reverse direction and pull the throttle out for forward direction or vise-versa, based on whether the trolling motor is mounted on the transom or bow of a boat. In either case, the handle is always moved in the same direction that the operator wants the boat to travel.

U.S. Pat. No. 7,895,959 discloses advanced steering system designs for marine vessels which incorporate non-linear tiller arms for rudder control, designed for creating different turning radii for discrete rudders. Differential tillers are utilized to create distinct angular displacement of the separate rudders in turning maneuvers, which enhance control and maneuverability of the marine vessels.

U.S. Pat. No. 7,090,551 discloses a tiller arm provided with a lock mechanism that retains the tiller arm in an upwardly extending position relative to an outboard motor when the tiller arm is rotated about a first axis and the lock mechanism is placed in a first of two positions. Contact between an extension portion of the lock mechanism and the discontinuity of the arm prevents the arm from rotating downwardly out of its upward position.

U.S. Pat. No. 6,406,342 discloses a control handle for a tiller of an outboard motor provided with a rotatable handle grip portion that includes an end surface which supports a plurality of push buttons that the operator of a marine vessel can depress to actuate certain control mechanisms and devices associated with the outboard motor. These push buttons include trim up and trim down along with gear selector push buttons.

U.S. Pat. No. 6,264,516 discloses an outboard motor provided with a tiller handle that enables an operator to control the transmission gear selection and the throttle setting by rotating the hand grip of the tiller handle. It also comprises a means for allowing the operator to disengage the gear selecting mechanism from the throttle mechanism. This allows the operator to manipulate the throttle setting without having to change the gear setting from neutral position.

U.S. Pat. No. 5,632,657 discloses a movable handle mounted to a trolling motor head. The handle is pivotally adjustable upwardly and downwardly to suit different positions of a fisherman while controlling the trolling motor. The handle spans across the motor head and acts as a tiller for pivoting the motor about its axis. The resistance to positional changes is adjustable and protective features are provided to prevent damage to the adjustment mechanism in the event of tightening. The handle incorporates therein various controls for the motor head.

U.S. Pat. No. 5,340,342 discloses a tiller handle provided for use with one or more push-pull cables connected to the shift and the throttle mechanisms of an outboard marine engine to control the shift and the throttle operations of the engine. The tiller handle includes a rotatable cam member with one or more cam tracks located on its outer surface. Each push-pull cable is maintained within a distinct cam track such that rotating the rotatable cam member actuates the push-pull cables thereby controlling the operation of the shift and the throttle mechanisms of the engine.

U.S. Pat. No. 4,878,468 discloses an outboard marine motor housed by a cowl assembly having an upper cowl section and a lower cowl section including various features for improving the structural integrity of the cowl assembly and for providing a water-resistant seal at the joint between the cowl sections and at various points of entry of cables and other mechanical devices. A cut-out portion in the side of the lower cowl assembly is adapted to receive various cables and shift levers for different configurations of outboard marine motors, e.g. a manual tiller-operated motor including shift controls, a manual tiller-operated motor having a separate shift lever, and a remote-control motor having throttle and shift cables leading into the engine cavity. A sealing mechanism is provided at the cut-out portion of the lower cowl assembly, to provide a water-resistant seal at the points of entry of the cables or shift lever through the lower cowl section.

U.S. Pat. No. 4,496,326 discloses a steering system for a marine drive having a propulsion unit pivotally mounted on the transom of a watercraft and a tiller. The steering system includes a steering vane rotatably mounted on the propulsion unit for generating hydrodynamic forces to pivot or assist in pivoting the propulsion unit and to counteract propeller torque. A mount interposed between the propulsion unit and the tiller mounts the tiller for movement relative to the propulsion unit. A cable connects the tiller to the steering vane so that movement of the tiller with respect to the propulsion unit rotates the vane. The mount includes mutually engageable elements that can lock the tiller against movement relative to the propulsion unit so that the tiller may be used to directly steer the propulsion unit, if desired. For this purpose, the elements of the mount may be engaged by applying a downward pressure on the tiller.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

The present disclosure provides a tiller for an outboard motor. The tiller comprises a supporting chassis having a first end and an opposite, second end. A rotatable throttle grip is supported on the first end and a pivot joint is located at the second end. The pivot joint is configured to facilitate pivoting of the tiller at least into and between a horizontal position wherein the supporting chassis extends horizontally and a vertical position wherein the supporting chassis extends vertically. A top cover is located on the supporting chassis. The top cover and the supporting chassis together define an interior of the tiller. The top cover is located vertically on top of the supporting chassis when the tiller is in the horizontal position.

BRIEF DESCRIPTION OF THE DRAWINGS

The present disclosure is provided with reference to the following drawing Figures. The same numbers are used throughout the drawing Figures to reference like features and like components.

DETAILED DESCRIPTION OF THE DRAWINGS

Figure 1:
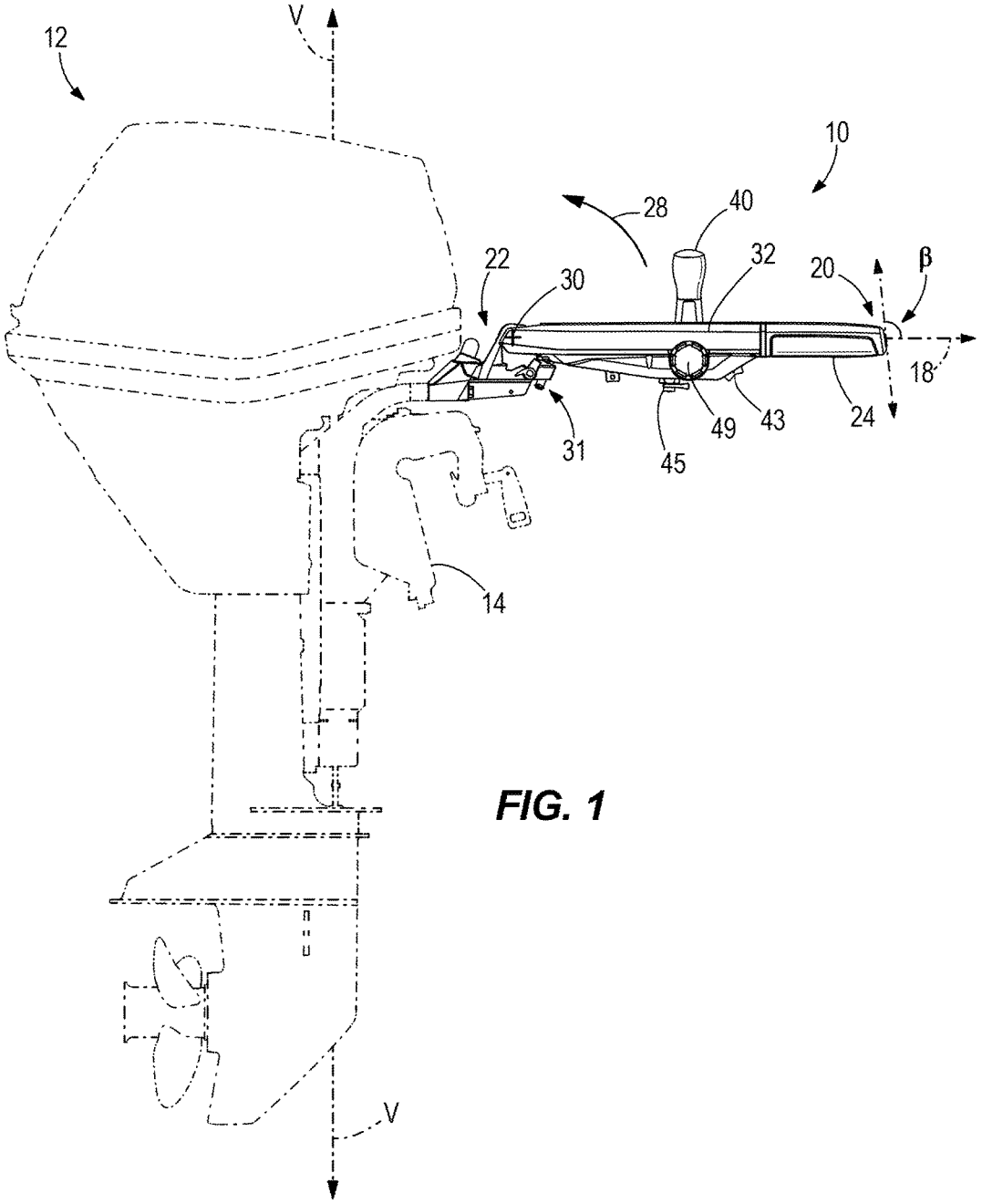
FIG. 1 is a side view of an outboard motor and a tiller according to the present disclosure.

FIG. 1 depicts a tiller 10 for use with an outboard motor 12, which is illustrated in dash-and-dot line format. The configuration of outboard motor 12 is exemplary and can vary from what is shown. In the illustrated example, the outboard motor 12 is configured for attachment to the transom of a marine vessel via a transom bracket 14, such that the outboard motor 12 is steerable about a vertical steering axis V, as is conventional.

Figure 2:
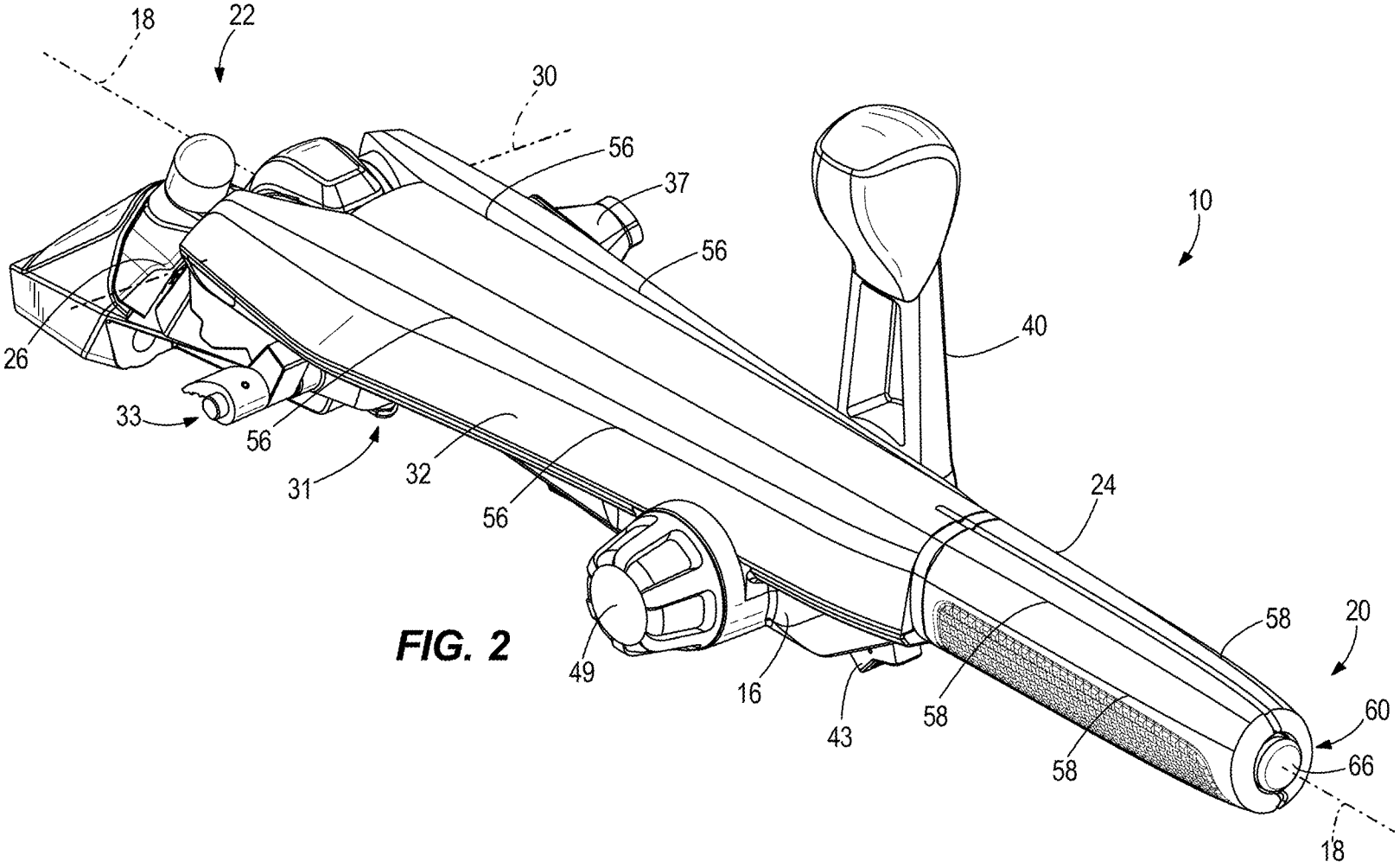
FIG. 2 is a perspective view of the tiller in a horizontal position.
Figure 3:
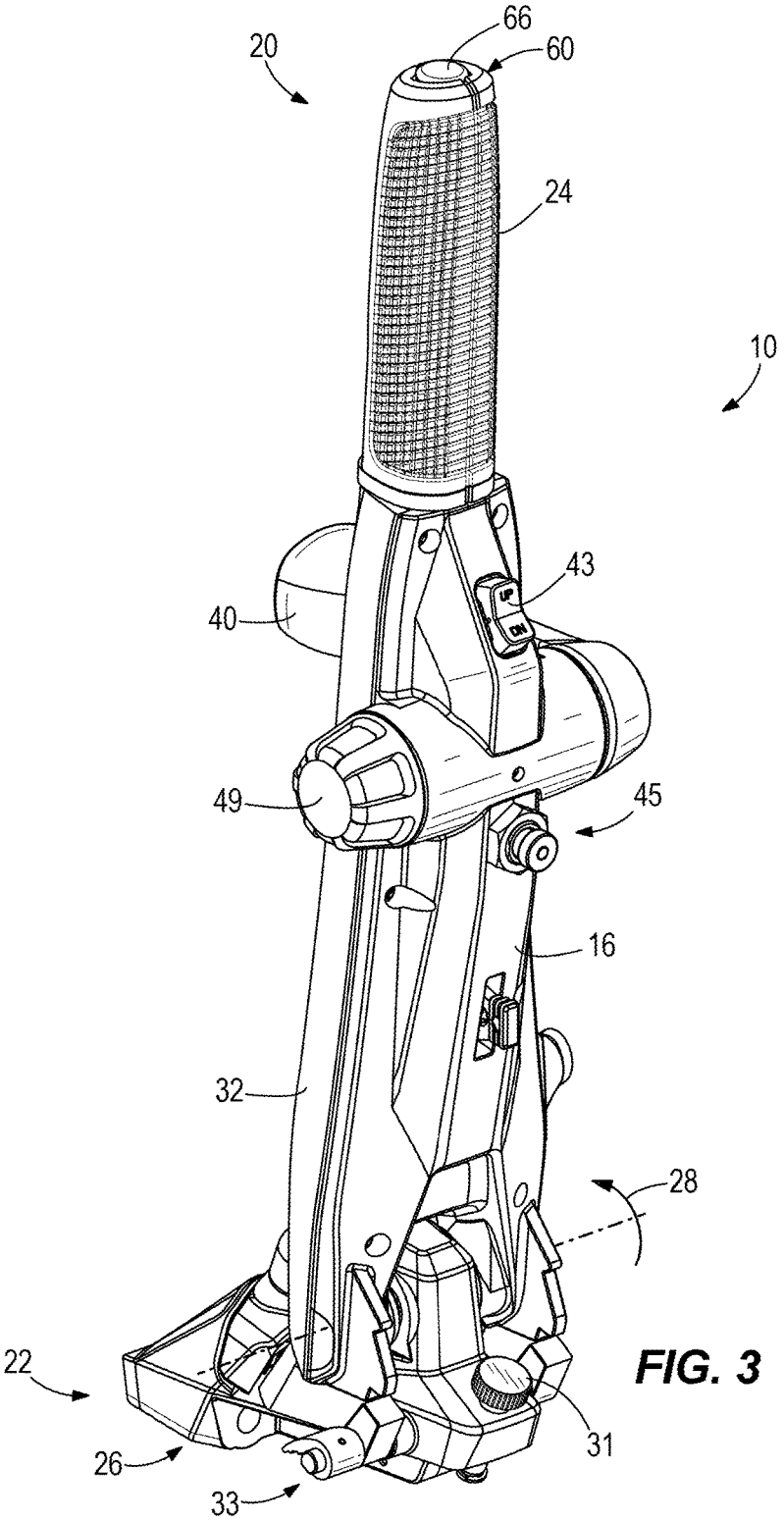
FIG. 3 is a perspective view of the tiller in a vertical position.

Referring to FIGS. 2-5, the tiller 10 has a supporting chassis 16 that extends in an axial direction along a tiller axis 18. The supporting chassis 16 has a first axial end 20 and an axially opposite, second axial end 22. A rotatable throttle grip 24 is supported on the first axial end 20. A pivot joint 26 is located at the second axial end 22, and is configured to facilitate pivoting of the tiller 10 through a range of motion 28 (FIGS. 1 and 3) including at least into and between a horizontal position (FIG. 2) where in the supporting chassis 16 extends horizontally and a vertical position (FIG. 3) where in the supporting chassis 16 extends vertically. In certain examples, the supporting chassis 16 is made of metal. The type and configuration of pivot joint 26 can vary from what is shown, and for example can include any one or a combination of the pivot joint embodiments disclosed in the co-pending U.S. patent application Ser. No. 14/254,528 which is incorporated herein by reference by entirety. In other examples, the pivot joint 26 can be a conventional pivot joint known to those having ordinary skill in the art. As is conventional, the pivot joint 26 allows for pivoting of the tiller 10 through the range of motion 28 about a horizontal pivot axis 30 (FIG. 2). A bolt 31 and ratchet lever 33 are located at the pivot joint 26 and facilitate positional and pivoting movement, as is conventional.

Figure 4:
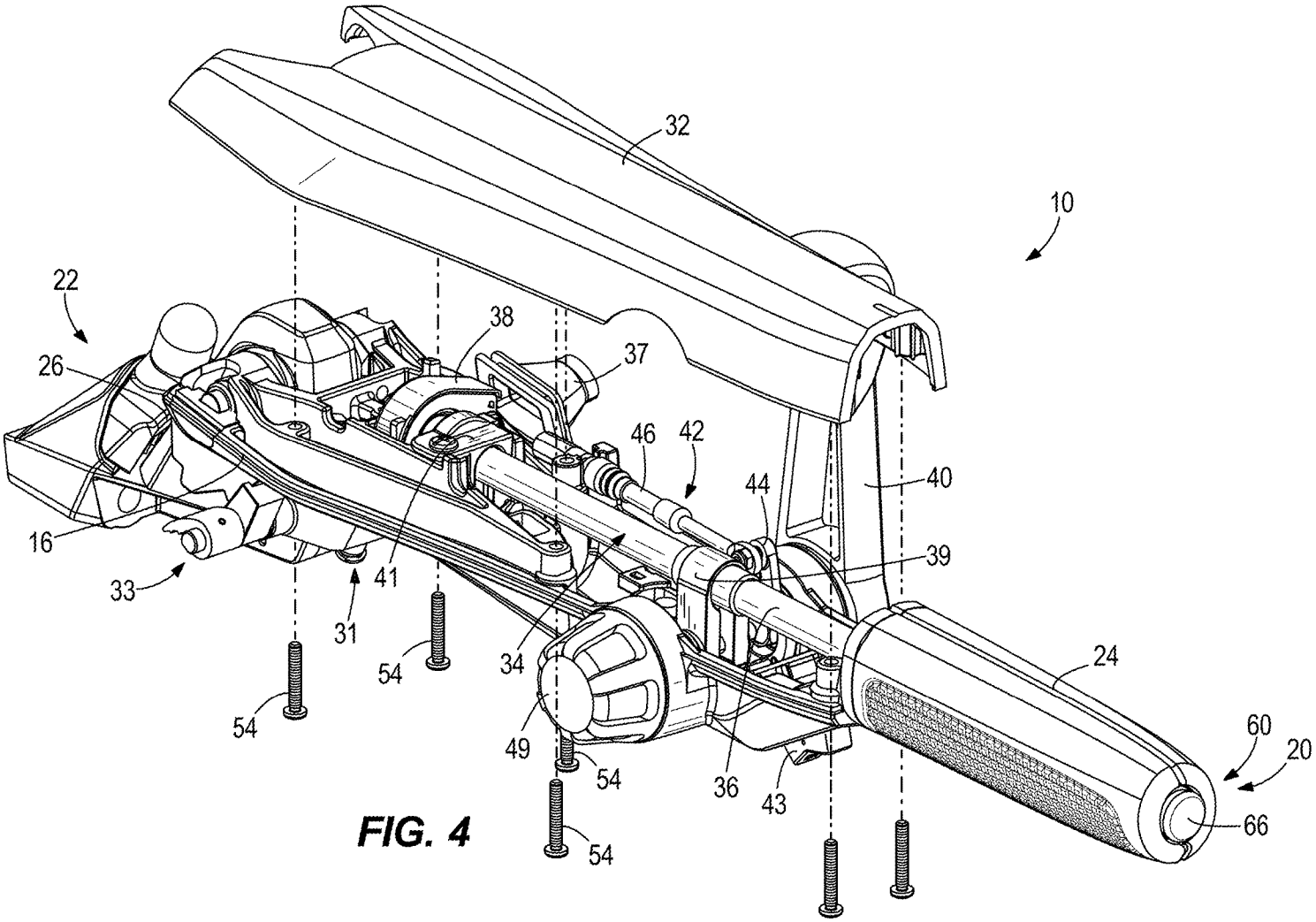
FIG. 4 is a perspective view of the tiller having the top cover removed.
Figure 5:
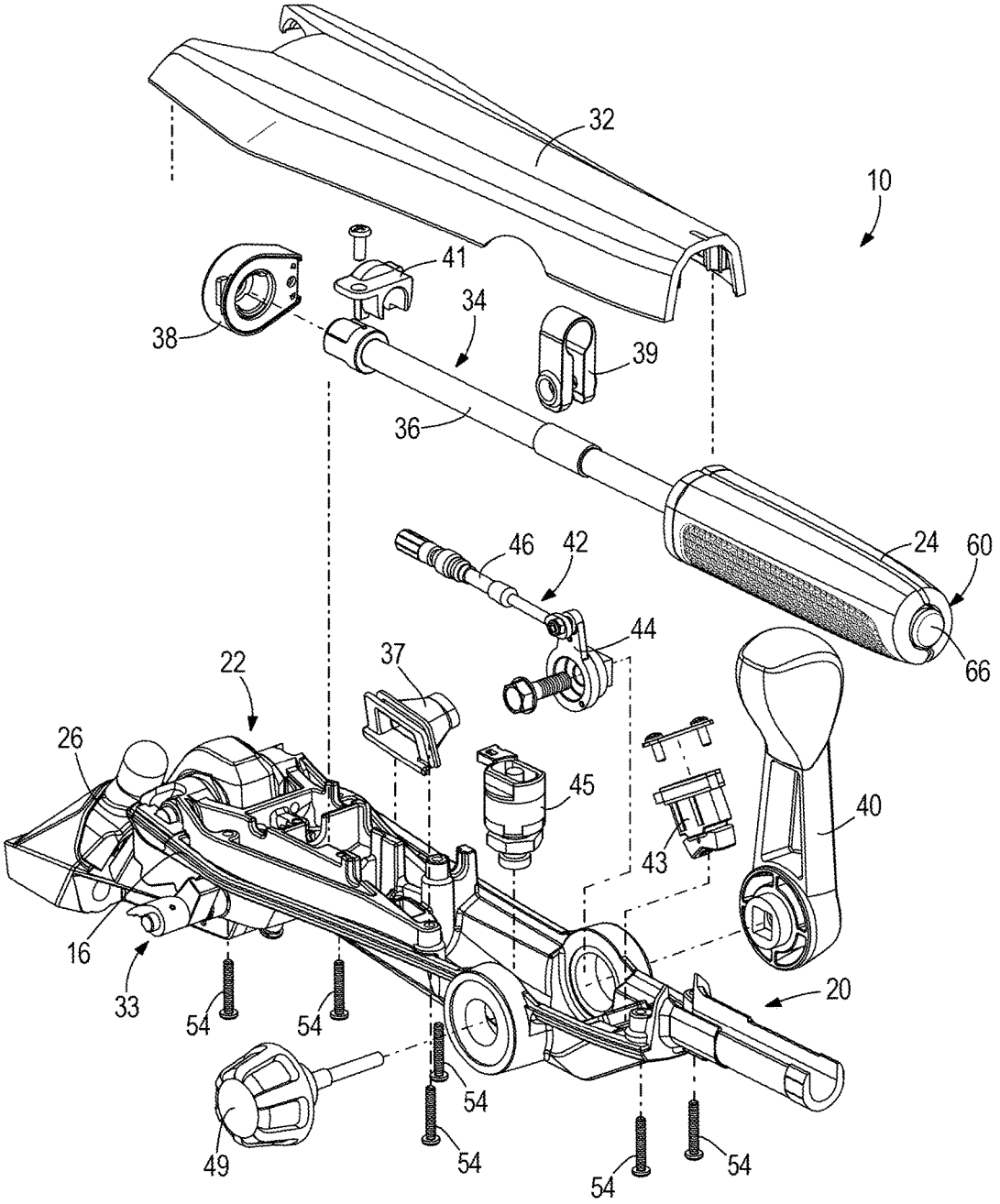
FIG. 5 is an exploded view of the tiller.

A top cover 32 is disposed on top of the supporting chassis 16. The top cover 32 and supporting chassis 16 together define an interior of the tiller 10. The top cover 32 is particularly located on top of the supporting chassis 16 when the tiller 10 is in the horizontal position (FIG. 2). Advantageously, the top cover 32 is removable from the supporting chassis 16 when the tiller 10 is in the horizontal position (FIG. 2). Thus, as illustrated in FIG. 4, removal of the top cover 32 provides access to the interior from above the tiller 10 when the tiller 10 is in the horizontal position (FIG. 2). This advantageously provides access to the interior in a more ergonomic and less awkward position than the prior art. In certain examples, the top cover 32 is made of plastic. Referring to FIG. 5, the top cover 32 is coupled to the supporting chassis 16 by removable fasteners 54. Removal of the fasteners 54 allows removable of the top cover 32 from the supporting chassis 16. In other examples, the top cover 32 is removably fastened to the supporting chassis 16 by a snap-fit engagement or other non-permanent connection. Advantageously the fasteners 54 are inserted from below the tiller 10 in the horizontal position. Thus the fasteners 54 remain hidden from view in the horizontal position, providing an aesthetically pleasing appearance.

Referring to FIG. 5, the tiller 10 has a throttle linkage 34 that links the rotatable throttle grip 24 to a throttle (not shown) on the outboard motor 12, as is conventional. The throttle linkage 34 includes a throttle shaft 36 that is disposed in the interior of the tiller 10 such that the supporting chassis 16 is located vertically beneath and supports the throttle shaft 36 when the tiller 10 is in the horizontal position (FIG. 2). The throttle shaft 36 thus extends parallel to the tiller axis 18 and is held in place by a mounting sleeve 39 and a hold-down bracket 41. Rotation of the rotatable throttle grip 24 causes rotation of the throttle shaft 36. A rotatable locking knob 49 is coupled to the mounting sleeve 39. Rotation of the locking knob 49 in one direction squeezes the mounting sleeve 39 to lock the position of the throttle shaft 36 and rotatable throttle grip 24 thus facilitating hands-free operation. Opposite rotation of the locking knob 49 relaxes the mounting sleeve 39 and thus allows manual rotation of the rotatable throttle grip 24 and associated throttle shaft 36.

The throttle linkage 34 further includes a throttle pulley 38 that is also disposed in the interior of the tiller 10 such that the supporting chassis 16 is located vertically beneath and supports the throttle pulley 38 when the tiller 10 is in the horizontal position (FIG. 2). The throttle pulley 38 is configured for connection to throttle cables (not shown) which extend through a grommet 37 in the supporting chassis 16 to a corresponding pulley on the throttle of the outboard motor (not shown). Rotation of the rotatable throttle grip 24 thus causes rotation of the throttle shaft 36, which rotates the throttle pulley 38, causing corresponding pulling motion on the noted throttle cables and corresponding pulley on the throttle of the outboard motor 12.

A manual shift lever 40 is coupled to the supporting chassis 16. A shift linkage 42 links the manual shift lever 40 to a transmission (not shown) on the outboard motor 12. The shift linkage 42 includes a shift link 44 that is disposed in the interior of the tiller 10 such that the supporting chassis 16 is located vertically beneath and supports the shift link 44 when the tiller 10 is in the horizontal position (FIG. 2). Manual shifting of the shift lever 40 causes corresponding rotation of the shift link 44, which translates a push cable 46. Translation of the push cable 46 causes corresponding shifting action in the transmission of the outboard motor 12, as is conventional.

Optional tiller components that are supported by the supporting chassis 16 include a manual trim switch 43 and associated circuitry, as well as a kill switch 45 and associated circuitry for shutting off the outboard motor in an emergency. The kill switch 45 is actuated by a conventional removable lanyard (not shown). These components are conventional and thus are not further described herein.

The present disclosure thus provides a tiller 10 that provides improved access for maintenance. The supporting chassis 16 is advantageously positioned on the underside of the tiller 10 in the horizontal position and underneath and supporting the internal components of the tiller 10. The easily removable top cover 32 protects the internal components of the tiller 10 and provides an aesthetically pleasing design. In use, the user simply removes the top cover 32 and can easily access the components of the tiller 10 in the horizontal position.

Figure 6:
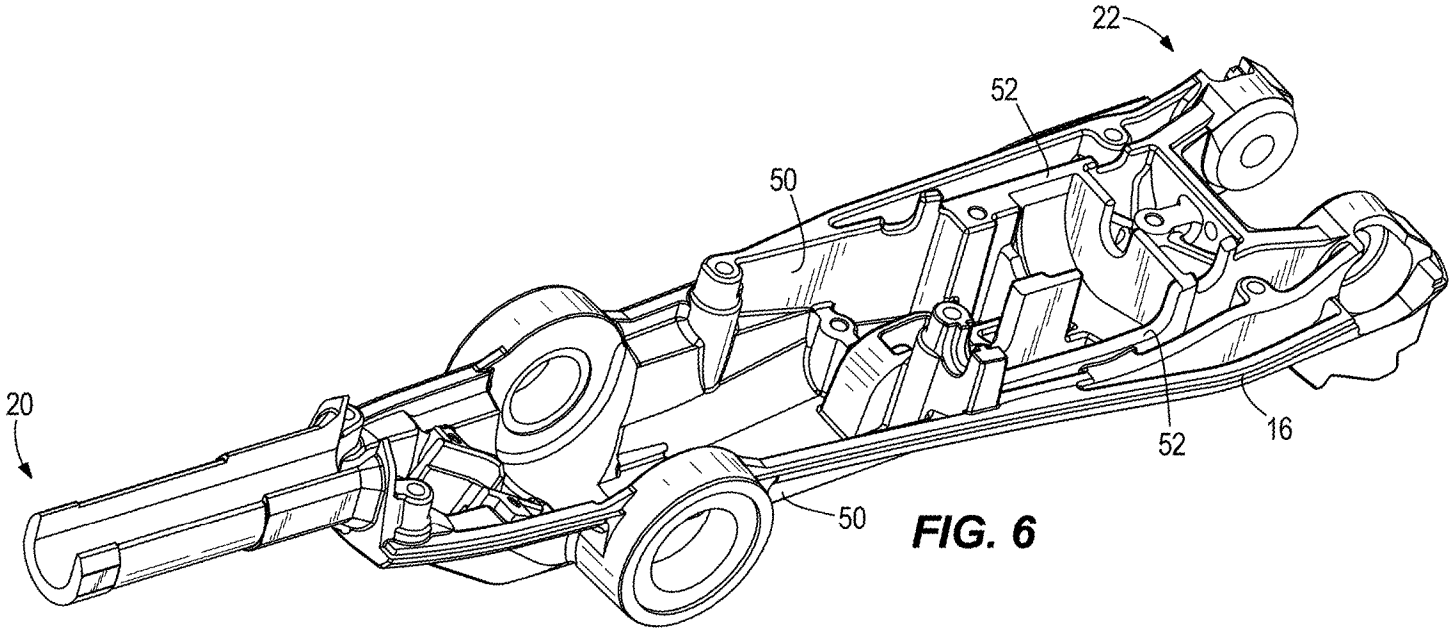
FIG. 6 is a perspective view of a supporting chassis.
Figure 7:
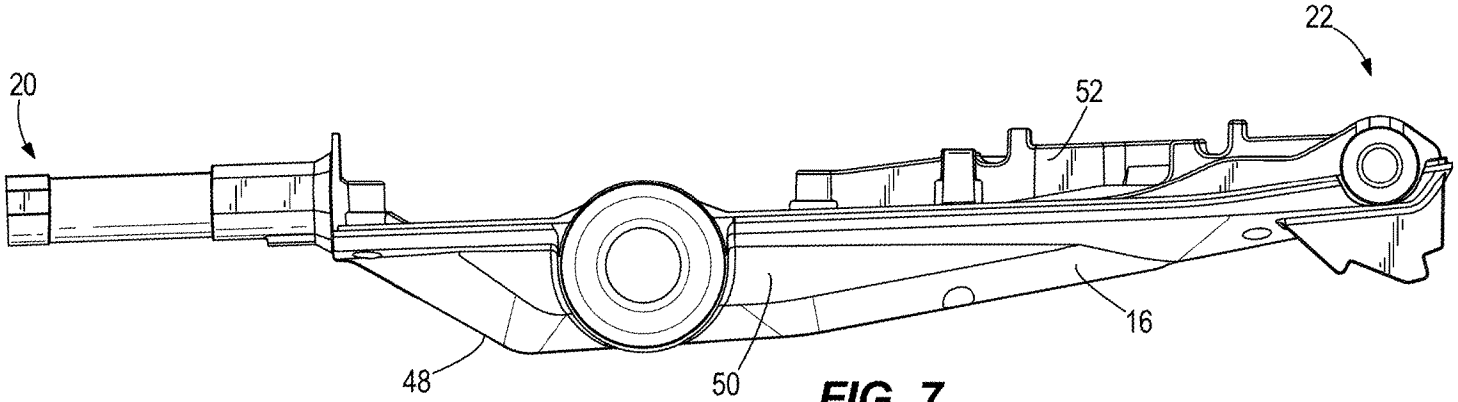
FIG. 7 is a side view of the supporting chassis.

As shown in FIGS. 6 and 7, the supporting chassis 16 includes a bottom wall 48 and opposing side walls 50 that extend vertically upwardly and on opposite sides of the bottom wall 48 when the tiller 10 in is the horizontal position (FIG. 2). A plurality of supporting ribs 52 is formed along the bottom wall 48. The supporting ribs 52 are located closer to the second axial end 22 and the first axial end 20. The supporting ribs 52 are advantageously configured to absorb reaction forces in the supporting chassis 16 due to a downward force applied to the first axial end 20 to the tiller 10, for example by a user placing their hand on the rotatable throttle grip 24 and pushing downwardly thereon. The supporting ribs 52 axially extend with respect to the supporting chassis and extend vertically higher than the side walls 50 when the tiller 10 is in the horizontal position, see FIGS. 2 and 7.

Referring to FIG. 2 a first set of axial alignment ribs 56 axially extends along the top cover 32. A second set of axial alignment ribs 58 extends along the rotatable throttle grip 24. The first and second sets of axial alignment ribs 56, 58 are in alignment when the rotatable throttle grip 24 is located in an idle position, see FIG. 2. In contrast, the first and second sets of axial alignments ribs 56, 58 move out of alignment with each other when the rotatable throttle grip 24 is located out of the idle position shown in FIG. 2. Advantageously, this allows the operator to see and feel the idle position on the tiller 10.

Referring to FIGS. 1 and 2, the rotatable throttle grip 24 also has a beveled end surface 60 that is set an angle ß with respect to vertical so that the beveled end surface 60 is visible from vertically above the tiller 10. The angle ß provides increased visibility and easier access to a kill switch 66 located at the beveled end surface 60 when the tiller 10 is in the horizontal position.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A tiller for an outboard motor, the tiller comprising:

a supporting chassis having a first end and an opposite, second end;

a rotatable throttle grip supported on the first end;

a pivot joint located at the second end, the pivot joint configured to facilitate pivoting of the tiller at least into and between a horizontal position wherein the supporting chassis extends horizontally and a vertical position wherein the supporting chassis extends vertically;

a top cover on the supporting chassis, wherein the top cover and the supporting chassis together define an interior of the tiller, and wherein the top cover is located vertically on top of the supporting chassis when the tiller is in the horizontal position;

wherein the top cover is removable from the supporting chassis when the tiller is in the horizontal position, and wherein removal of the top cover provides access to the interior from above the tiller when the tiller is in the horizontal position;

wherein the supporting chassis comprises a bottom wall and opposing sidewalls that extend vertically upwardly on opposite sides of the bottom wall when the tiller is in the horizontal position; and a plurality of supporting ribs formed along the bottom wall, wherein the supporting ribs are located closer to the second end than the first end and absorb reaction forces in the supporting chassis due to a downward force applied to the first end;

wherein the plurality of supporting ribs axially extend with respect to the supporting chassis and extend vertically higher than the sidewalls when the tiller is in the horizontal position.

2. A tiller for an outboard motor, the tiller comprising:

a supporting chassis having a first end and an opposite, second end;

a rotatable throttle grip supported on the first end;

a pivot joint located at the second end, the pivot joint configured to facilitate pivoting of the tiller at least into and between a horizontal position wherein the supporting chassis extends horizontally and a vertical position wherein the supporting chassis extends vertically;

a top cover on the supporting chassis, wherein the top cover and the supporting chassis together define an interior of the tiller, and wherein the top cover is located vertically on top of the supporting chassis when the tiller is in the horizontal position; and a first set of axial alignment ribs that axially extend along the top cover and a second set of axial alignment ribs that axially extend along the rotatable throttle grip, wherein the first and second sets of axial alignment ribs are in alignment when the rotatable throttle grip is located in an idle position and wherein the first and second sets of axial alignment ribs are out of alignment when the rotatable throttle grip is located out of the idle position.

3. A tiller for an outboard motor, the tiller comprising:

a supporting chassis that extends in an axial direction, the supporting chassis having a first axial end and an axially opposite, second axial end;

a rotatable throttle grip supported on the first axial end;

a pivot joint located at the second axial end, the pivot joint configured to facilitate pivoting of the tiller through a range of motion including at least into and between a horizontal position wherein the supporting chassis axially extends horizontally and a vertical position wherein the supporting chassis axially extends vertically;

a top cover on top of the supporting chassis, wherein the top cover and the supporting chassis together define an interior of the tiller, and wherein the top cover is located vertically on top of the supporting chassis when the tiller is in the horizontal position;

wherein the top cover is removable from the supporting chassis when the tiller is in the horizontal position, and wherein removal of the top cover provides access to the interior from above the tiller when the tiller is in the horizontal position;

a throttle linkage that is configured to link the rotatable throttle grip to a throttle on the outboard motor, the throttle linkage comprising a throttle shaft that is disposed in the interior of the tiller such that the supporting chassis is located vertically beneath and supports the throttle shaft when the tiller is in the horizontal position, wherein rotation of the rotatable throttle grip causes rotation of the throttle shaft; and a manual shift lever coupled to the chassis and a shift linkage that is configured to link the manual shift lever to a transmission on the outboard motor, the shift linkage being disposed in the interior of the tiller such that the supporting chassis is located vertically beneath and supports the shift linkage when the tiller is in the horizontal position, wherein manually shifting the shift lever causes rotation of the shift linkage;

wherein removal of the top cover when the tiller is in the horizontal position provides manual access to the throttle linkage and shift linkage which remain supported in the chassis in the horizontal position.

4. The tiller according to claim 3, wherein the chassis comprises a bottom wall and opposing sidewalls that extend vertically upwardly on opposite sides of the bottom wall when the tiller is in the horizontal position.

5. The tiller according to claim 4, further comprising a plurality of supporting ribs formed along the bottom wall, wherein the supporting ribs are located closer to the second axial end than the first axial end and absorb reaction forces in the chassis due to a downward force applied to the first end.

6. The tiller according to claim 5, wherein the plurality of supporting ribs axially extend with respect to the supporting chassis.

7. The tiller according to claim 6, wherein the ribs extend vertically higher than the sidewalls when the tiller is in the horizontal position.

8. The tiller according to claim 3, wherein the top cover is coupled to the chassis by a plurality of removable fasteners, wherein removal of the fastener allows removal of the top cover from the chassis.

9. The tiller according to claim 3, further comprising a first set of axial alignment ribs that axially extend along the top cover and a second set of axial alignment ribs that axially extend along the rotatable throttle grip, wherein the first and second sets of axial alignment ribs are in alignment when the rotatable throttle grip is located in an idle position and wherein the first and second sets of axial alignment ribs are out of alignment when the rotatable throttle grip is located out of the idle position.

10. A tiller for an outboard motor, the tiller comprising:

a supporting chassis that extends in an axial direction, the supporting chassis having a first axial end and an axially opposite, second axial end;

a rotatable throttle grip supported on the first axial end;

a pivot joint located at the second axial end, the pivot joint configured to facilitate pivoting of the tiller through a range of motion including at least into and between a horizontal position wherein the supporting chassis axially extends horizontally and a vertical position wherein the supporting chassis axially extends vertically;

a top cover on top of the supporting chassis, wherein the top cover and the supporting chassis together define an interior of the tiller, and wherein the top cover is located vertically on top of the supporting chassis when the tiller is in the horizontal position;

wherein the rotatable throttle grip comprises a beveled end surface that is set at an angle to the axial direction so that the beveled end surface is visible from above the tiller when the tiller is in the horizontal position; and a kill switch on the beveled end surface for ceasing operation of the outboard motor.

* * * * *